United States Patent [19]

Imose et al.

[11] Patent Number: 4,501,553

[45] Date of Patent: Feb. 26, 1985

[54] FLOATING EQUIPMENT AND FLOATING-TYPE HEAT TREATING FURNACE FOR STRIPLIKE WORKS

[75] Inventors: Masayuki Imose, Kawanishi; Takao Seno, Mino; Yoshihito Sakaguchi, Kyoto, all of Japan

[73] Assignee: Chugai Ro Co., Ltd., Osaka, Japan

[21] Appl. No.: 570,032

[22] Filed: Mar. 2, 1984

Related U.S. Application Data

[62] Division of Ser. No. 391,704, Jun. 24, 1983, Pat. No. 4,455,136.

[51] Int. Cl.[3] ..... F27B 9/28; F26B 13/20

[52] U.S. Cl. ..... 432/59; 432/8; 34/156

[58] Field of Search ..... 34/156; 432/59, 8

[56] References Cited

U.S. PATENT DOCUMENTS

| | | | |
|---|---|---|---|
| 3,485,429 | 12/1969 | Hutzenlaub | 34/156 |
| 3,877,684 | 4/1975 | Kurihara et al. | 432/59 |
| 3,982,327 | 9/1976 | Kurie et al. | 34/156 |
| 3,982,328 | 9/1976 | Gustafsson et al. | 34/156 |
| 4,085,522 | 4/1978 | Stroszynski | 34/156 |
| 4,148,946 | 4/1979 | Byrd et al. | 432/8 |
| 4,274,210 | 6/1981 | Stengard | 34/156 |
| 4,326,342 | 4/1982 | Schregenberger | 432/59 |
| 4,384,666 | 5/1983 | Koponen et al. | 34/156 |

*Primary Examiner*—Henry C. Yuen
*Attorney, Agent, or Firm*—H. Duane Switzer

[57] ABSTRACT

An improved floatation-type pressure pad is described as having lines of jet nozzles which are so arranged at the opposing ends of the pad that streams or jets of gas, emitting from the nozzles and striking a strip of material passing nearby, tend to stretch the material in a crosswise direction to flatten the strip and eliminate any crosswise distortions in the strip. Ancillary to this, is vertically offsetting pairs of adjacent pads to momentarily form in the strip of material, an inclination or wave in a lengthwise direction to help flatten the strip and eliminate such distortions in the strip.

4 Claims, 5 Drawing Figures

FLOATING EQUIPMENT AND FLOATING-TYPE HEAT TREATING FURNACE FOR STRIPLIKE WORKS

This is a division of application Ser. No. 391,704, filed June 24, 1983, now U.S. Pat. No. 4,455,136.

BACKGROUND OF THE INVENTION

The invention relates to a floater-type heat treating furnace, especially the floatation-type pressure pads which are designed to support a continuous strip of material, e.g. aluminum or copper, on a fluidized bed as the strip travels through the furnace.

Pressure pads are widely used to float strips of soft, easily deformable materials, under low tension, through heat treating furnaces, since such materials are susceptible to being damaged, if they are allowed to contact rigid rolls that are oftentimes used to physically support and guide strips of metal through a furnace. The pressure pads are normally arranged in pairs which confront the pathway or pass line along which the strip moves through the furnace. Each pad generally comprises two parallel rows or lines of jet nozzles which extend longitudinally of the pad and which are designed to direct streams or jets of gas in a normal direction against the moving strip. Each row of jet nozzles may consist of a number of spaced and aligned perforations, or a single, continuous slit or slot which is coextensive with the width of the strip. In either case, the lines of jet nozzles of opposing pads are designed to create a static field pressure upon which the strip is supported.

It has been found that the aforementioned conventional pressure pads do not adequately support the strip which becomes wavy in a crosswise direction and assumes the shape of the wing of a seagull throughout its width, i.e. the center and opposing marginal edges of the strip are closer the vertically lowermost pressure pads than the portions of the strip between the center and marginal edges. The invention is designed to eliminate this problem by the provision of an improved pressure pad which supports the strip in a flattened condition.

Briefly stated, the invention is in a pressure pad which comprises two rows or lines of jet nozzles for directing streams or jets of gas against a strip of material which is passing nearby. The lines of jet nozzles are made to converge towards each other adjacent opposing ends of the pads, so that the streams or jets of gas emitting from the converging lines of jet nozzles, each have a component of force in a laterally outward direction tending to stretch the strip in a crosswise direction.

Another aspect of the invention is the offsetting of adjacent pairs of confronting pads to produce a wave lengthwise in the strip to help flatten the strip.

DESCRIPTION OF THE DRAWING

The following description of the invention will be better understood by having reference to the accompanying drawing, wherein.

DETAILED DESCRIPTION OF THE DRAWING

Figure 1:
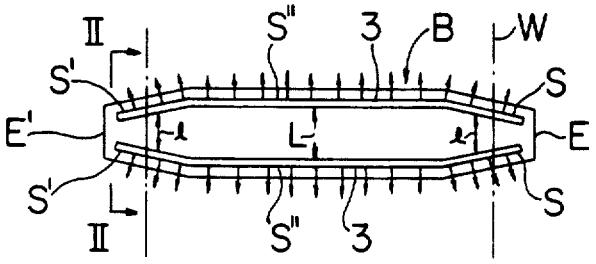
FIG. 1 is a plan view of a pressure pad embodying the invention.
Figure 2:
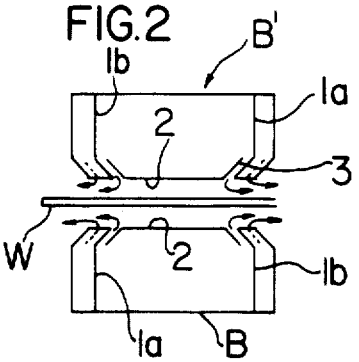
FIG. 2 is a view of the pad from the line II—II of FIG. 1.

With general reference to the drawing for like parts, and specific reference to FIGS. 1 and 2, there is shown an improved pressure pad B which is made in accordance with the invention and which is used in conjunction with another, confronting like pressure pad B' to produce between them, a static gas pressure upon which a strip W of material, such as aluminum or copper, is supported as it passes between the pads B, B', each of which pads comprises two rows or lines of jet nozzles 1*a* and 1*b* which face the strip W. In this instance, the jet nozzles 1*a* and 1*b* in the confronting faces 2 of the pads B, B' are continuous slits or slots 3 which, as best seen in FIG. 1, extend longitudinally of the pads and are coextensive with the width of the strip W. The slots 3 of a conventional pad A are parallel and normal to the direction in which the strip W travels past the pad. The slots 3 of the improved pad B are also parallel and so disposed, except adjacent the opposing ends E, E' of the pad B, where the sections S,S' of the slots 3 converge towards each other and the longitudinal centerline of the pad, such that the distances 1 between the ends of the slots 3, or lines of jet nozzles 1*a* and 1*b*, gradually narrow compared to the constant distance L between the parallel center sections S'' of the slots 3.

It can be appreciated by those skilled in the art, that the streams or jets of gas emitting from the outer side sections S,S' of the slots 3 will have a component of force in a laterally outwardly direction from the longitudinal centerline of the strip W, as the gas strikes the strip W. Such components of force tend to stretch the strip W in a crosswise direction, so to speak, to eliminate, or substantially reduce, any waviness in the strip and flatten the strip to prevent distortion and consequent damage to the strip.

Figure 3:
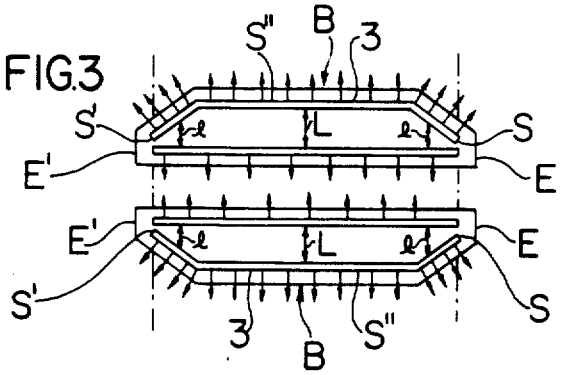
FIG. 3 is a plan view of a different embodiment of a pad which is made in accordance with the invention.
Figure 4:
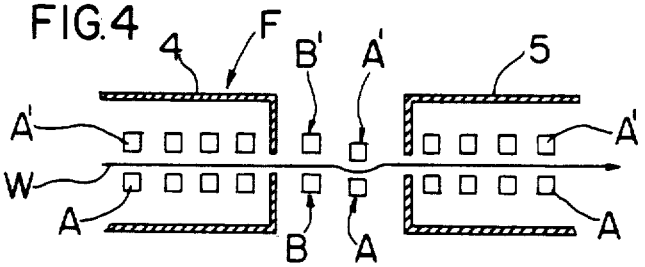
FIG. 4 is a schematic side view of a heat treating furnace which has horizontally spaced heating and cooling sections between which are pairs of vertically offset pads, one of which pairs of pads are made in accordance with the invention.

With particular reference to FIG. 4, there is shown another embodiment of the invention where one of the slots 3 is straight across the pad B and the other opposing slot 3 is provided with converging sections S,S', similar to those shown in FIG. 1, except that the angular dispositions of the slot sections S,S', shown in FIG. 3, are greater.

Figure 5:
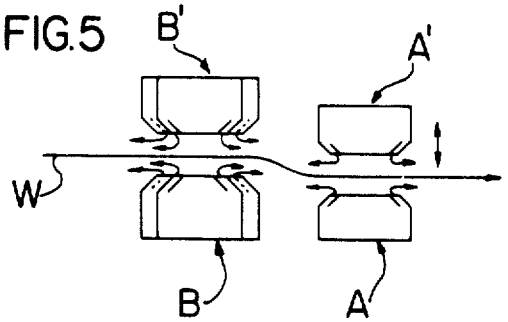
FIG. 5 is an enlarged sectional view of the pairs of vertically offset pads illustrated in FIG. 4.

With particular reference to FIG. 4, there is shown a heat treatment furnace F which comprises a heating zone 4 which is horizontally aligned with a cooling zone 5 which is horizontally spaced from the heating zone 4. A pair of conventional pressure pads A,A' and a pair of improved pads B,B' are positioned between the heating and cooling zones 4,5. The conventional pressure pads A,A' are adjustable vertically, so that they can be vertically offset from the improved, stationary pads B,B' to produce momentarily, an inclination or short wave longitudinally of the strip W, as more clearly seen in FIG. 5, to help correct any crosswise deformation of the strip, as previously described. This wave creating action by means of gas emitting from vertically offset pads, is similar to that produced by conventional roll levellars.

Listed below are the results of tests made to flatten and eliminate crosswise deformation of a strip of aluminum 1.3 mm thick and 1,550 mm wide, and under a tension of 500 kg, and wherein the gas jet nozzles of the pads A,A′ and B,B″ were 80 mm apart. The pressure of gas from the pads A,A′ was equivalent to 90 mm of $H_2O$, and the pressure of gas from the improved pads B,B′ was equivalent to 95 mm of $H_2O$. The vertical offset between the pads A,A′ and B,B′ was 30 mm.

| TEMPERATURE OF STRIP | CROSS-SECTIONAL SHAPE OF STRIP ENTERING FLOATING EQUIPMENT OF INVENTION | CROSS-SECTIONAL SHAPE OF STRIP LEAVING FLOATING EQUIPMENT OF INVENTION |
|---|---|---|
| 440° C. | 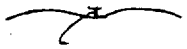 40 mm | FLAT |
| 480° C. | 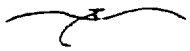 55 mm | FLAT |
| 515° C. | 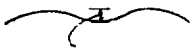 65 mm | SUBSTANTIALLY FLAT |

The above-described methods of eliminating crosswise deformation of a strip of material may be used alone or, in combination, depending on the degree of strip deformation experience and the strip flatness desired. The jet nozzles may be inclined in the direction of the width of the strip to prevent mistracking of the strip through the various zones of the furnace. Thus, there has been described a relatively simple and inexpensive way of eliminating cross-wise deformation of a strip of material that is floated on a fluid bed which is created, for example, in a heat treatment furnace for supporting the strip as it travels through the furnace.

What is claimed:

1. A pressure pad for directing jet or streams of fluid against an adjacent, continuous strip of material adapted to travel along a flow path which is generally parallel to a first axis of the pad, the pressure pad comprising:

a first line of jet nozzles including first jet nozzle opposite end portions with one of the opposite end portions disposed at each end of a first jet nozzle central portion, at least one of the first jet nozzle end portions being disposed at an angle relative to the pad first axis and diverging outwardly thereof from the first central portion toward the one first jet nozzle outer terminal end such that the outer terminal end is spaced further from the pad first axis than an inner terminal and thereof disposed at the first central portion; and a second line of jet nozzles including second jet nozzle opposite end portions with one of the opposite end portions disposed at each end of a second jet nozzle central portion, at least one of the second jet nozzle end portions being disposed at an angle relative to the pad first axis and diverging outwardly thereof such that an outer terminal end of the one second jet nozzle end portions is spaced further from the pad first axis than an inner terminal end thereof disposed at the second central portion; wherein the jet nozzles of at least the first and second jet nozzle one end portions and the first and second jet nozzle other end portions are angularly disposed in such manner that jets of fluid emitting therefrom and striking a material strip passing adjacent thereto exert an outward force on the strip along the pad first axis which tends to stretch the strip.

2. The pressure pad of claim 1 wherein the first jet nozzle opposite end portions are disposed on a diverging relationship to each other from the inner terminal ends to the outer terminal ends thereof.

3. The pressure pad as set forth in claim 1 wherein the first and second jet nozzle central portions extend generally transverse to the pad first axis.

4. The pressure pad as set forth in claim 1 wherein the first jet nozzle end and central portions include a first continuous slot and wherein the second jet nozzle end and central portions including a second continuous slot.

* * * * *